United States Patent [19]

Rohner

[11] Patent Number: 4,653,258

[45] Date of Patent: Mar. 31, 1987

[54] METHOD AND DEVICE FOR PRODUCING A THREAD CONNECTION BY SPLICING

[75] Inventor: Joachim Rohner, Monchen-Gladbach, Fed. Rep. of Germany

[73] Assignee: W. Schlafhorst & Co., Monchen Glabach, Fed. Rep. of Germany

[21] Appl. No.: 753,650

[22] Filed: Jul. 10, 1985

[30] Foreign Application Priority Data

Jul. 10, 1984 [DE] Fed. Rep. of Germany ..... 3425349

[51] Int. Cl.[4] ..... D01H 15/00

[52] U.S. Cl. ..... 57/22

[58] Field of Search ..... 57/22

[56] References Cited

U.S. PATENT DOCUMENTS 4,356,688 11/1982 Zürcher ..... 57/22

4,416,110 11/1983 Mima ..... 57/22

4,492,076 1/1985 Romic et al. ..... 57/22

4,494,366 1/1985 Deno ..... 57/22

4,499,715 2/1985 Chardon et al. ..... 57/22

*Primary Examiner*—Donald Watkins

*Attorney, Agent, or Firm*—Herbert L. Lerner; Laurence A. Greenberg

[57] ABSTRACT

A method of producing a tension-proof thread connection by splicing includes preparing threads for splicing by contacting ends of the thread with a hot gas before splicing for dissolving the thread ends into open-ended individual fibers, for softening the individual fibers and for making the fibers better suited for splicing; and subsequently splicing the threads by alternatingly tangling, interlocking, swirling and intertwining the fibers of the thread ends, and a device for carrying out the method.

12 Claims, 2 Drawing Figures

METHOD AND DEVICE FOR PRODUCING A THREAD CONNECTION BY SPLICING

Figure 1:
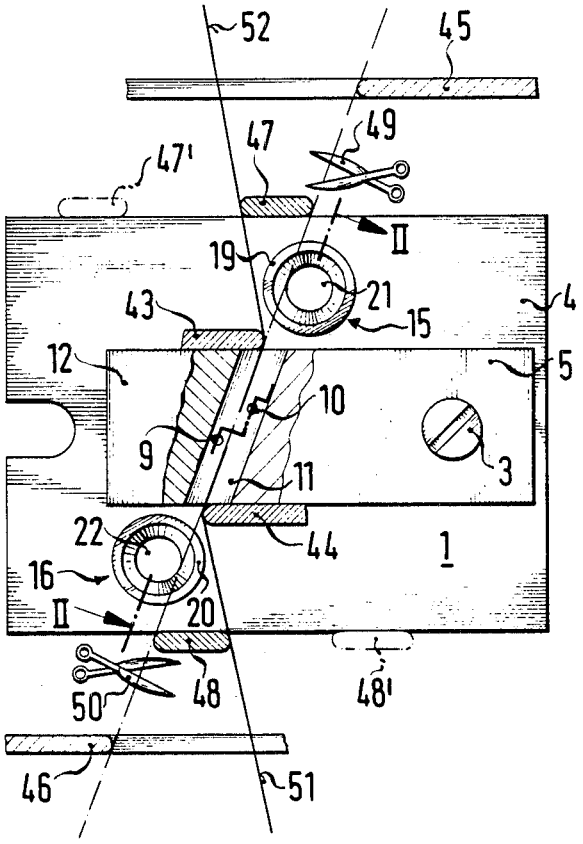

The invention relates to a method and a device for producing a thread connection by splicing, wherein an alternating tangling, interlocking, swirling and/or intertwining of the fibers of the thread ends leads to a tension-proof connection of the threads.

During formation of thread connections by splicing, it is difficult to effectively prepare the thread end obtained by cutting the thread for the subsequent splicing operation, during the short time span available for the preparation of the thread ends. This applies especially for threads whose fibers do not have the feel and softness of good spinning fibers.

It is accordingly an object of the invention to provide a method and device for producing a thread connection by splicing, which overcomes the hereinafore-mentioned disadvantages of the heretoforeknown methods and devices of this general type, to guarantee durable thread connections by splicing, and in particular to reduce the number of faulty splices, i.e. the number of splicing operations which must be repeated because the splice either does not connect, or the tensile strength of the thread connection is not sufficient.

With the foregoing and other objects in view there is provided, in accordance with the invention, a method of producing a tensionproof thread connection by splicing, which comprises preparing threads for splicing by contacting ends of the thread with a hot gas before splicing for dissolving the thread ends into open-ended individual fibers, for softening and individual fibers and for making the fibers better suited for splicing; and subsequently splicing the threads by alternatingly tangling, interlocking, swirling and/or intertwining the fibers of the thread ends.

Any suitable gaseous medium is included under the term "hot gas". Hot air should be considered in particular, because hot air is easily available and can be economically obtained.

In accordance with another mode of the invention, there is provided a method comprising generating a current with the hot gas for contacting the thread ends. This is done in order to perform the preparation of pre-treatment of the thread ends as rapidly as possible. Flowing hot gas guarantees a fast heat transfer into the fibers and at the same time contributes to the rapid and thorough loosening of the thread end to form open-ended individual fibers. In this way, short fibers which do not contribute to the strength of the splicing point, are blown away from the thread end.

In accordance with a further mode of the invention, there is provided a method which comprises swirling the thread ends with a current of the hot gas. It is advantageous if turbulence is created in the hot gas stream as it flows around the thread ends. When generating ths turbulence, the thread twist should be taken into consideration, so that the direction of the turbulence of the hot gas is opposed to the direction of twist of the thread.

If two thread endings are to be connected, the two thread ends can be positioned alongside each other, for example, and then prepared together for splicing by the hot gas.

In accordance with an added mode of the invention, there is provided a method which comprises contacting each thread end with at least one current of the hot gas flowing from a container, channel or tube under a positive pressure. If the hot gas stream acts on each thread end, it is not necessary for the thread ends to lie adjacent each other. This is advantageous because automatic splices can be more rapidly made and more successful this way, due to the splicing apparatus.

In accordance with the additional mode of the invention, there is provided a method which comprises enriching or air conditioning the hot gas with a fluid or liquid medium at room temperature. The media which should be considered are those that are present in gaseous form and not in the liquid state in the hot gas, and only return to the liquid state during cooling, i.e. as a rule during the splicing operation itself, and then moisten the fibers. This moistening of the fibers during the splicing operation is required only for a short time. The drying effect of the splicing air during the splicing operation can then dry the previously finished splice again.

Water is a liquid medium which is suited for the preparation of the thread ends and is easily available. If hot air is used, the hot air can be enriched and conditioned with water. The temperature can drop below the dew point after the hot air flow has stopped, so that, for instance, the thread ends which have already been prepared for splicing enter the splicing operation laden with moisture due to the thawing of its fibers which has already begun.

In accordance with another mode of the invention, there is provided a method which comprises splicing the threads subsequent to preparing the threads for splicing with the hot gas by: introducing the thread ends into a splicing chamber of a compressed gas thread splicing device, and blowing moisture-enriched heated compressed gas into the splicing chamber. This may also be done in some cases after being enriched with a medium which is liquid at room temperature.

The concept of using moisture should not be limited to water, but instead it relates to any medium which is liquid at room temperature. Accordingly, the moistening takes place either during the preparation of the thread ends, during the splicing operation itself, or during the preparation of the thread ends as well as during the splicing operation.

In accordance with again a further mode of the operation, there is provided a method which comprises keeping the temperature of the compressed gas in the splicing chamber lower than the hot gas preparing the threads for splicing. For instance, if the thread ends are prepared by moisture-laden hot air while the splicing itself is done with cold air, the temperature drops below the dew point in the splicing chamber at the latest. In this way the fibers are wetted or subjected to dew for a short time. The fibers therefore become still softer. However, this wetness is soon lost, because the fibers become dryer during splicing with cold air, as the strength of the splice increases. The finished splice then contains practically no moisture. The additional wetting serves only for achieving a better splice.

In order to perform the method there is provided a device for producing a tension-proof spliced thread connection by alternatingly tangling, interlocking, swirling and/or intertwining fibers of thread ends, comprising at least one pneumatic holding device for holding at least one thread end, the pneumatic holding device having an inlet opening formed therein for introuding the thread end into the holding device allowing retraction of the thread end after preparation for splicing, and the pneumatic holding device having a flow channel communicating with the inlet opening for receiving the thread ends and for allowing a directed hot gas stream, a hot gas source, and means for connecting the flow channel to the hot gas source. Accordingly, the preparation of the thread end takes place in a flow channel in to which the thread end projects, while the other end of the flow channel leads to the outside. For example, the hot gas stream can be blown into the flow channel in the direction toward the thread end. It is also possible to provide an injector channel which terminates in the flow channel and from which the hot gas flows out for pulling along additional air from the environment.

In accordance with another feature of the invention, there are provided means for controlling the means for connecting the flow channel to the hot gas source. For instance, a heat exchanger can serve as the source for the hot gas. The source of the hot gas can be separated from the connection with the flow channel by a controllable valve, for example.

In accordance with a further feature of the invention, the hot gas source and/or the means for connecting the flow channel to the hot gas source includes a gas moistening device. If the hot air is used as the gas, water is used for moistening because of reasons of simplicity. This can be done in an air conditioning device, which then serves as a moistening device.

In accordance with again an added feature of the invention, the pneumatic holding device includes a tube having the flow channel formed therein, the tube having an injector bore formed therein, and including a ring channel surrounding the tube and being in communication with the flow channel through the injector bore, and the means for connecting the flow channel to the hot gas source include a controllable valve.

In accordance with a concomitant feature of the invention, there is provided a splicing head of a compressed gas thread splicing device containing a splicing chamber, the at least one pneumatic holding device being in the form of two holding devices each being disposed at a respective side of the splicing head. This is advantageous because the threads coming from opposite sides can lie alongside each other in the splicing chamber even during the preparation of the thread ends, so that after their preparation, the threads ends can be brought into the splicing chamber by simply retracting them, after which they are connected there by splicing with each other.

Other features which are considered as characteristic for the invention are set forth in the appended claims.

Although the invention is illustrated and described herein as embodied in a method and device for producing a thread connection by splicing, it is nevertheless not intended to be limited to the details shown, since various modifications and structural changes may be made therein without departing from the spirit of the invention and within the scope and range of equivalents of the claims.

Figure 2:
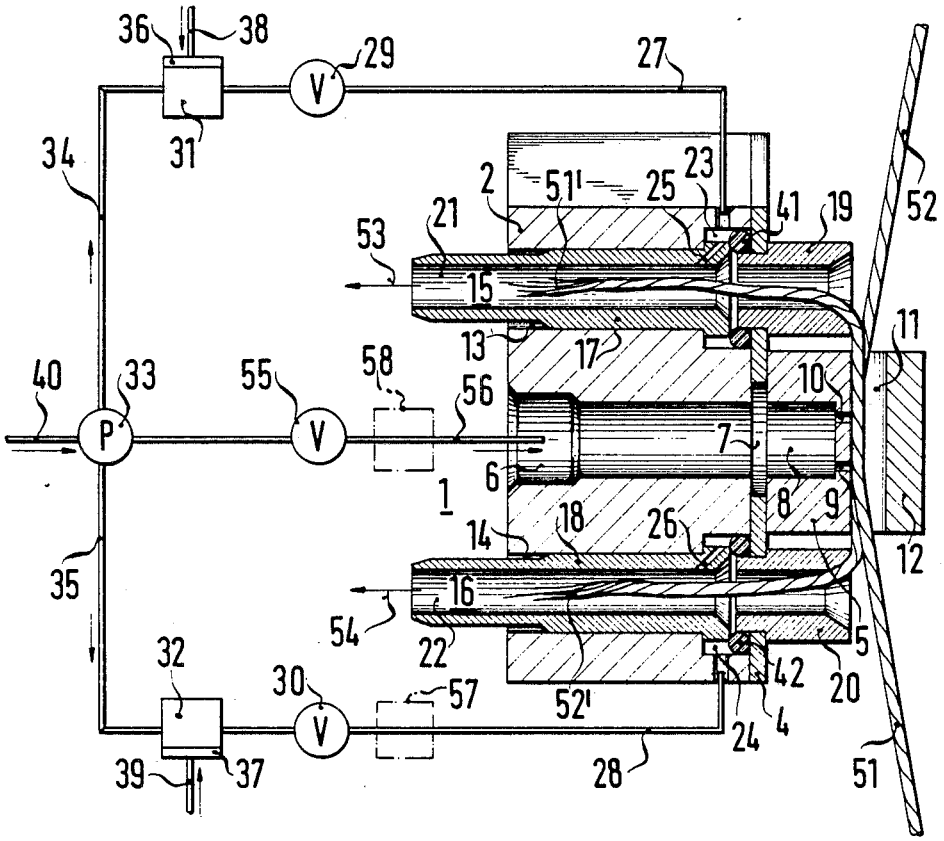

The construction and method of operation of the invention, however, together with additional objects and advantages thereof will be best understood from the following description of specific embodiments when read in connection with the accompanying drawings, in which:

FIG. 1 is a fragmentary, diagrammatic, partially sectional, frontelevational view of a compressed gas thread splicing device; and FIG. 2 is a cross-sectional view of the compressed gas thread splicing device taken along the line II-II in FIG. 1, in the direction of the arrows, including a schematic gas circuit.

Referring now as a whole to FIGS. 1 and 2 of the drawings in detail, there is seen a compressed gas thread splicing device 1 of which only the parts that are essential for the invention are shown. The splicing device 1 is formed of a basic body 2, to which a plate 4 and a splicing head 5 are fastened by a screw 3. A bore 6 formed in the basic body 2 is connected to a bore 8 formed in the splicing head 5 through an opening 7 formed in the plate 4. Two compressed gas inlet orifices 9 and 10 lead from the bore 8 into the splicing chamber 11, which can be closed by a cover 12. The cover can be opened for inserting the threads and the cover closes the splicing chamber 11 toward the front for the splicing operation. Two additional bores 13, 14 formed in the basic body 2 serve for housing two pneumatic holding devices 15, 16. The pneumatic holding device 15 is formed of a tube 17, which extends toward the front of the splicing device into a tube extension 19 that serves as an entrance port. The pneumatic holding device 16 has a tube 18 which extends toward the front of the splicing device into a tube extension 20. The tube extensions or inlet openings 19 and 20 are disposed in the plate 4 and fastened therein. The tube 17 forms a flow channel 21 and the tube 18 forms a flow channel 22. The tube 17 is surrounded at the upper end thereof by a ring channel 23 and the tube 18 is similarly surrounded by the upper end thereof by a ring channel 24. Both ring channels are disposed in the basic body 2. The ring channel 23 is connected with the flow channel 21 by an injector hole 25 and the ring channel 24 is connected with the flow channel 22 by an injector hole 26. The ring channel 23 is attached through a pipe line 27 and a control valve 29 to a hot gas source 31. The ring channel 24 is attached through a pipe line 28 and a control valve 30 to a hot gas source 32. The sources for hot gas may be heat exchangers which may heat fresh air coming from a compressor 33. The fresh air is conducted through pipe lines 34, 35, respectively, to the hot gas sources 31, 32, respectively.

The hot gas source 31 is provided with a gas moistening device 36 and the hot gas source 32 has a gas moistening device 37.

The compressor 33 sucks in fresh air through a line 40, compresses it, and conducts it through the lines 34 and 35 to the hot gas sources 31 and 32, where the air is heated to a temperature of about 100 degrees and is charged with humidity by injecting water with the aid of the gas moistening devices 36 and 37. The water is supplied through pipe lines 38, 39, respectively.

Since positive pressure is provided in the ring channels 23 and 24 during the preparation of the thread ends, rubber-elastic O-rings 41 and 42 are provided for simultaneously sealing and holding the tubes 17 and 18.

FIG. 1 shows that a cover member 43 is provided at the upper end of the splicing chamber 11 which partly covers the splicing chamber and that a similar cover member 44 is provided at the lower end of the splicing chamber 11. The top of the basic body 2 has a thread guiding plate 45 and the bottom thereof has a thread guiding plate 46. Loop pulling means 47, 48 and thread cutting devices 49, 50 which are only indicated in FIG. 1 are disposed between the cover plates 43, 44 and the thread guiding plates 45, 46, respectively. The loop pulling means 47 can be moved to the position 47' and the loop pulling means 48 can be moved into the position 48'.

FIG. 1 shows the position of threads 51 and 52 after they have been inserted into the splicing chamber 11, but before they are severed, and thereby before the preparation of thread ends 51', 52', respectfully, which are shown especially clearly in FIG. 2. The thread 51 comes from the lower right, changes its direction at the cover member 44, passes through the splicing chamber 11, and is conducted through the pneumatic holding device 15 and the opened thread cutting device 49, toward the upper right. The other thread 52 comes from the upper left, changes its direction at the cover member 43, runs through the splicing chamber 11, passes through the pneumatic holding device 16, and is conducted to the lower left through the opened thread cutting device 50.

The thread ends 51' and 52' in their subsequent condition shown in FIG. 2, are produced by the operation of the two thread cutting devices 49, 50. Simultaneously with the cutting of the threads, the valves 29, 30 are opened, so that conditioned hot air flows into the ring channels 23, 24 and from there through the injector holes 25 and 26 into the flow channels 21, 22. Thus, a turbulent hot air flow is generated which reaches the outside in the direction of the arrows 53 and 54. The hot air stream pulls along air from the surroundings, whereby the thread ends are moved first into the tube extensions 19, 20, respectively, and from there into the flow channels 21 and 22.

Both valves 29 and 30 remain open for a limited time period. During this time, bunches of open-end individual fibers are produced at the ends of the threads, as is somewhat indicated in FIG. 2. Then, the two loop pulling means 47 and 48 are moved to the positions 47', 48', respectively, while taking along the threads 52, 51, respectively and forming loops, so that the thread ends 51' and 52' are pulled out of the flow channels 21 and 22 and moved into the splicing chamber 11. During this splicing preparation operation, the valves 29 and 30 may remain open. However, this is not required in all cases.

For the actual splicing with the cover 12 closed, a valve 55 is opened and compressed air is blown into the bore 6 through a pipe line 56 by the compressor 33. In this way, positive pressure is generated in the bore 6, which escapes through the compressed gas inlet orifices 9 and 10 leading into the splicing chamber 11. The inflowing compressed air causes an alternating tangling, interlocking, swirling and/or intertwining of the fibers of the thread ends, which results in a tension-proof splicing connection. The fibers of the thread ends and the moisture-laden hot air still present between the fibers therefore cools down to the dew point temperature, so that the fibers are wetted for a short time. Cooling below the dew point can even take place in the flow channels 21 and 22 after the valves 29 and 30 have closed.

After the splicing connection has been made, the cover 12 is opened, so that the joined threads 51 and 52 can jump out of the splicing chamber 11 toward the front of the splicing device, as soon as tension is created, such as by restarting a winding device.

The invention is not limited to the illustrated and described embodiment, which was used as an example. For instance, in FIG. 2 a location 57 is indicated in phantom where the hot gas source 32 and/or the gas moistening device 37 could be alternatively positioned. It is also not absolutely necessary to use the same compressor for providing the hot gas sources and for generating the splicing air. It would also be economical to use the escaping hot air for pre-heating of the air flowing into the hot gas sources. Furthermore, the line 56 which carries the splicing air could also be provided with a hot gas source and/or a gas moistening device, such as at a point 58 indicated in phantom.

I claim:

1. Method of producing a tension-proof thread connection by splicing, which comprises heating a gas to a given hot temperature sufficient for dissolving thread ends and softening individual thread fibers, preparing threads for splicing by contacting ends of the thread with the gas at the given hot temperature before splicing for dissolving the thread ends into open-ended individual fibers, for softening the individual fibers and for making the fibers better suited for splicing; and subsequently splicing the threads by introducing the thread ends into a splicing chamber of a compressed gas thread splicing device, and blowing moisture-enriched heated compressed gas into the splicing chamber for alternatingly tangling, interlocking, swirling and intertwining the fibers of the thread ends.

2. Method according to claim 1, which comprises generating a current with the hot temperature gas for contacting the thread ends.

3. Method according to claim 1, which comprises swirling the thread ends with a current of the hot temperature gas.

4. Method according to claim 1, which comprises contacting each thread end with at least one current of the hot temperature gas flowing from a container under a positive pressure.

5. Method according to claim 1, which comprises enriching the hot temperature gas with a fluid medium at room temperature.

6. Method according to claim 1, which comprises conditioning the hot temperature gas with a fluid medium at room temperature.

7. Method according to claim 1, which comprises keeping the temperature of the compressed gas in the splicing chamber lower than the hot temperature gas preparing the threads for splicing.

8. Device for producing a tension-proof spliced thread connection by alternatingly tangling, interlocking, swirling and intertwining fibers of thread ends, comprising at least one pneumatic holding device for holding at least one thread end, said pneumatic holding device having an inlet opening formed therein for receiving the thread end and for relinquising the thread end after preparation for splicing, and said pneumatic holding device having a flow channel communicating with said inlet opening for receiving the thread ends and for conducting a directed hot gas stream, means for heating a gas to a given hot temperature sufficient for dissolving thread ends and softening individual thread fibers, means for connecting said flow channel to said gas heating means, a splicing chamber of a compressed gas thread splicing device, means for introducing the thread ends into said splicing chamber, and means for blowing moisture-enriched heated compressed gas into said splicing chamber.

9. Device according to claim 8, including means for controlling said means for connecting said flow channel to said gas heating means.

10. Device according to claim 8, wherein said means for connecting said flow channel to said gas heating means includes a gas moistening device.

11. Device according to claim 8, wherein said pneumatic holding device includes a tube having said flow channel formed threrein, said tube having an injector bore formed therein, and including a ring channel surrounding said tube and being in communication with said flow channel through said injector bore, and said means for connecting said flow channel to said gas heating means includes a controllable valve.

12. Device according to claim 8, wherein said at least one pneumatic holding device is in the form of two holding devices each being disposed at a respective side of said splicing head.

* * * * *